US008807857B2

(12) United States Patent
L'Abbate

(10) Patent No.: US 8,807,857 B2
(45) Date of Patent: Aug. 19, 2014

(54) MAKE UP PACKAGING, FLASK REFILL AND METHOD OF SUBSTITUTING REFILL

(75) Inventor: Frederico de Carvalho L'Abbate, São Paulo (BR)

(73) Assignee: Natura Cosméticos S.A., Itapecerica da Serra SP (BR)

( * ) Notice: Subject to any disclaimer, the term of this patent is extended or adjusted under 35 U.S.C. 154(b) by 494 days.

(21) Appl. No.: 13/141,473

(22) PCT Filed: Dec. 23, 2009

(86) PCT No.: PCT/BR2009/000420

§ 371 (c)(1),
(2), (4) Date: Aug. 1, 2011

(87) PCT Pub. No.: WO2010/071954

PCT Pub. Date: Jul. 1, 2010

(65) Prior Publication Data

US 2012/0020720 A1 Jan. 26, 2012

(30) Foreign Application Priority Data

Dec. 24, 2008 (BR) ..... 0804192
Jan. 30, 2009 (FR) ..... 09 50592

(51) Int. Cl.
*A46B 11/00* (2006.01)

(52) U.S. Cl.
USPC ..... 401/129; 132/218; 401/126

(58) Field of Classification Search
USPC ..... 401/121, 122, 126–130; 132/218; 220/23.89, 23.83, 23.87; 206/229, 361, 206/15.2, 581, 38
See application file for complete search history.

(56) References Cited

U.S. PATENT DOCUMENTS

| | | | | |
|---|---|---|---|---|
| 3,347,403 | A * | 10/1967 | Lehrman | 220/23.87 |
| 4,705,053 | A | 11/1987 | Goncalves | |
| 5,934,457 | A * | 8/1999 | Ueda et al. | 206/204 |
| 6,945,419 | B2 | 9/2005 | Bertazza et al. | |
| 7,090,420 | B2 * | 8/2006 | De La Poterie et al. | 401/1 |

(Continued)

FOREIGN PATENT DOCUMENTS

| | | |
|---|---|---|
| EP | 0161980 | 11/1985 |
| WO | WO 03/007750 | 1/2003 |
| WO | WO 2008/130166 | 10/2008 |

*Primary Examiner* — David Walczak
*Assistant Examiner* — Jennifer C Chiang
(74) *Attorney, Agent, or Firm* — Alston & Bird LLP

(57) ABSTRACT

The present invention refers to a device providing for the use of a refill applicable to make up packagings having as main characteristic the detachment of the refill by double torsional moment. This invention also provides for the moment applicable on the cap has a different strength that the moment applicable on the base. The present invention refers to, more particularly, to a make up packaging (1) comprising a cap (2), a flask (3) and a refill (4), a cap (2) comprising a refill of the cap (7) connectable to an outer container of the cap (5), the flask (3) comprising a flask refill (8) connectable to an outer container of the flask (6), a packaging comprising a cap (2) connectable to and detachable from the flask (3) by means of a first torsional moment the flask refill (8) being connectable to and detachable from the outer flask container (6) by means of a second torsional moment substantially greater than the first torsional moment, the cap refill (7) being connectable to and detachable from the cap (2) by means of a third torsional moment substantially greater than the second torsional moment or vice-versa.

18 Claims, 4 Drawing Sheets

(56) References Cited

U.S. PATENT DOCUMENTS

| | | | | |
|---|---|---|---|---|
| 7,621,411 | B2 * | 11/2009 | Doherty et al. | 215/228 |
| 7,972,073 | B2 * | 7/2011 | Vintimiglia | 401/129 |
| 8,479,940 | B2 * | 7/2013 | Marra et al. | 220/23.87 |
| 2006/0051153 | A1 | 3/2006 | Delage | |
| 2006/0102192 | A1 | 5/2006 | Fischer et al. | |
| 2008/0000494 | A1 * | 1/2008 | Sek | 132/317 |
| 2009/0044824 | A1 * | 2/2009 | Stachowski | 132/218 |

* cited by examiner

MAKE UP PACKAGING, FLASK REFILL AND METHOD OF SUBSTITUTING REFILL

CROSS REFERENCE TO RELATED APPLICATIONS

This application is a national stage application, filed under 35 U.S.C. §371, of International Application No. PCT/BR2009/000420, filed Dec. 23, 2009, which claims priority to Brazilian Application No. PI0804192-0, filed Dec. 24, 2008, and French Application No. 0950592, filed Jan. 30, 2009, all of which are hereby incorporated by reference in their entirety.

BACKGROUND OF THE INVENTION

1. Field of Invention

The present invention refers to a packaging providing for the use of a refill applicable for cosmetics having as its main characteristic the detachment of the refill by double torsional moment. The invention also provides for the moment applicable on the cap having a different strength than the moment applicable on the base.

Additionally, the present invention refers to a flask refill that is also detachable by torsional moment.

2. Description of Related Art

The growing demand for reusable products and the concern with the final destination of polymer-based objects, due to their long degradation time, has led industries in general to modify their product strategies. The culture of reusing materials has been widely disseminated in society, and with this consumers are more aware and give preference to products with an ecological and/or social appeal.

The state of the art for make up product refills is limited, because there are still not many cosmetic packagings that allow content substitution. Most current make up packagings are disposable in the name of practicality.

In general terms, the current products that allow the exchange of refill are not portable or are unattractive. The solutions found still provided for substitutions using tabs or other devices to assist the exchange, or complex procedures.

One of the prior arts is described in document U.S. Pat. No. 6,945,419, which reveals a container for cosmetic products in general constituted by an extractable hollow cartridge, by an outer body, and by a cap. Removable locking means are provided between the cartridge and the outer body. The cartridge is threaded to the outer body of the product by the bottom, and the outer body and the cartridge are joined by pressure fixing means exercised by the cartridge protrusions and recesses of the hollow outer body.

Another prior art described in document U.S. Pat. No. 4,705,053 is a make up unit that comprises a container for mascara, an adjuster ring controls the compression and a reservoir of mascara, said refill, is accommodated in a barrel. Thus the degree of compression of the wiper element can be adjusted and, as a result, the force of the wiping action will be adjusted.

The document WO 2008/130166 discloses a direct jet type dispenser and a makeup tool using the dispenser. The makeup tool includes a dispenser and an application member. The dispenser includes a storage container storing the contents, a valve which has a cut part opened by external force, a discharge unit which is mounted to the storage container and guides the contents from the storage container, and a jet unit.

The documents described herein provide for the use of refills making the use of the packaging entirely original in aesthetic terms without exposing that there is a refill product inside. However, these products fail to meet the demand of upmarket users, associated to practicality of use and reuse.

The present invention has the advantage of not requiring the use of tools to substitute the refill, the substitution being provided by a single kind of movement.

BRIEF SUMMARY

The present invention is a make up packaging, comprising a cap, a flask and a refill detachable by three ranges of torsion with different intensities for consecutive and controlled detachment of the refill from the flask and refill of the cap.

The objects of the present invention are:

- a packaging where the connection and the detachment of the refill is carried out in a simplified manner and also without the use of any assistance tool;
- a packaging where various parts are taken apart in a controlled and sequential way;
- aesthetic concept does not show that there is a refill inside;
- enables unlimited use of the packaging;
- reduction of manufacturing costs;
- aesthetically original product without compromising its functionality and practicality of use; and
- an ecologically friendly product.

Said objects are achievable by a make up packaging comprising a cap, a flask refill, a cap comprising a refill of the cap connectable to an outer container of the cap, the flask comprising a flask refill connectable to an outer container of the flask, a packaging comprising a cap connectable to and detachable from the flask by means of a first torsional moment in which the flask refill is connectable to and detachable from the outer flask container by means of a second torsional moment substantially greater than the first torsional moment, the cap refill being connectable to and detachable from the cap by means of a third torsional moment substantially greater than the second torsional moment or vice-versa.

The present invention is also translated wherein the refill is connectable to and detachable from the cap, in which the second torsional moment is 2.5 to 10 times greater than the first torsional moment and the third torsional moment is 5 to 25 times greater than the first torsional moment. Additionally, the torsional moments comprise strength ranges wherein said strength ranges of the torsional moments are uninterrupted, and the third moment is 2 to 2.5 times greater than the second torsional moment, the range of the first torsional moment is 0.1 to 1.0 kgf, or 0,980665 N to 9,80665 N, the range of the second torsional moment is 1.0 to 2.5 kgf, or 9,80665N to 24,516625 N and the range of the third torsional moment 2.5 to 5.0 kgf, or 24,516625 N to 49,03325N.

According to the present invention, the flask comprises an accommodation base with at least one axial projection to accommodate the flask refill, and the flask refill is connectable to the accommodation base, and the flask refill comprises an applicator comprised of a wand and a brush, and the second torsional moment detaches the flask refill from the accommodation base, a cap refill and a flask refill, the flask refill being connectable to an outer flask container of a make up product packaging, the cap refill being connectable to and detachable from the cap of the make up product packaging by means of a first torsional moment, the flask refill being connectable to and detachable from the outer flask container by means of a second torsional moment and the cap refill being connectable to and detachable from the cap by means of a third torsional moment substantially greater than the second torsional moment or vice-versa.

Further according to the present invention, there is provided a method of substituting refill of a make up packaging comprising a cap, a flask and a refill, a cap comprising a refill of the cap connectable to an outer container of the cap, the flask comprising a flask refill connectable to an outer container of the flask, the method being characterized by comprising the steps of: (a) transmitting a first torsional moment to connect the cap to the flask, (b) transmitting a second torsional moment, greater than the first moment to detach the flask refill from the outer flask container; (c) transmitting a third torsional moment, greater than prior moments detaching the cap refill from the cap.

Concerning the method of substitution, the second torsional moment 2.5 to 10 times greater than the first torsional moment and the third torsional moment 10 to 25 times greater than the first torsional moment. The third torsional moment is 2 to 2.5 times greater than the second torsional moment.

Still concerning the method of substituting the refill, the range of the first torsional moment is 0.1 to 1.0 kgf, or 0,980665 N to 9,80665 N, the range of the second torsional moment is 1.0 to 2.5 kgf, or 9,80665N to 24,516625 N, and the range of the third torsional moment 2.5 to 5.0 kgf, or 24,516625 N to 49,03325N.

BRIEF DESCRIPTION OF THE FIGURES

The present invention will now be described in further details, with reference to the drawings appended hereto, wherein.

DETAILED DESCRIPTION OF VARIOUS EMBODIMENTS

Figure 1:
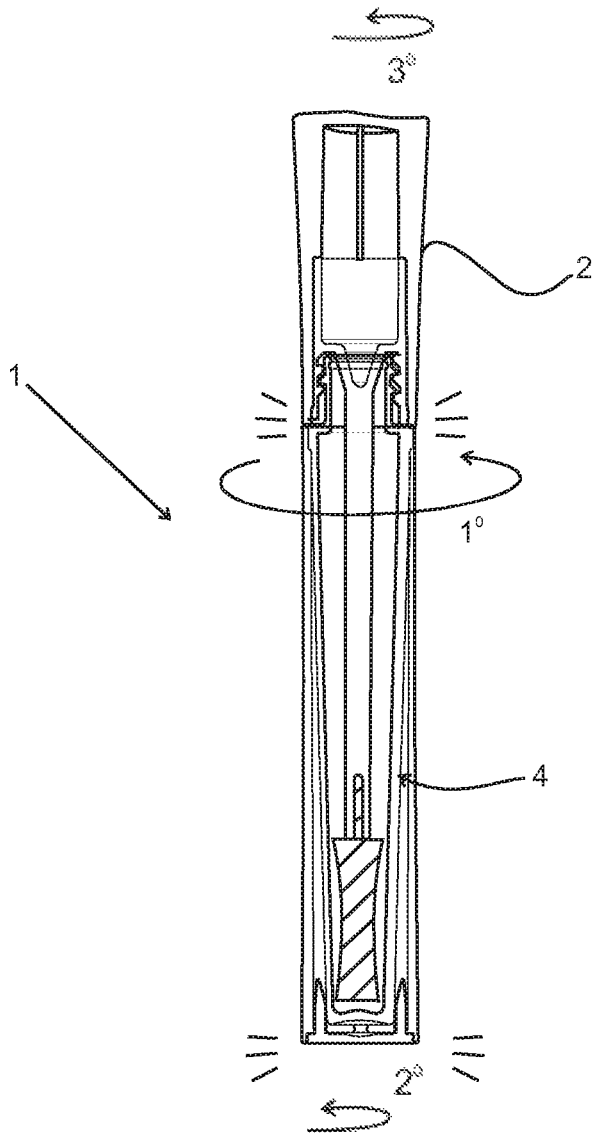
FIG. 1—refers to a side view of the packaging comprising the flask, cap and refill, and illustrates the torsional detachment moments of the refill that is the object of the present invention.
Figure 2:
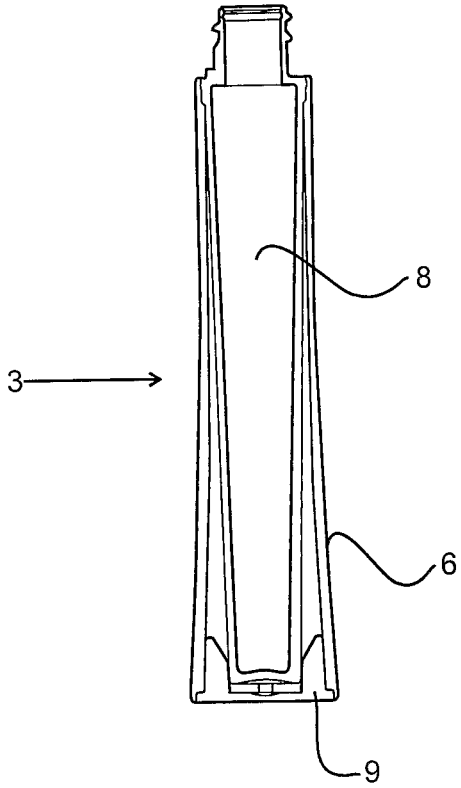
FIG. 2—refers to a side cut of the flask, the flask refill, outer flask container and base of the flask that is the object of the present invention.

As can be seen in FIG. 1, a make up packaging 1, according to the teachings of the present invention, comprises a cap 2, a flask 3 and a refill 4. A view of the flask 3 can be seen in FIG. 2.

Figure 3:
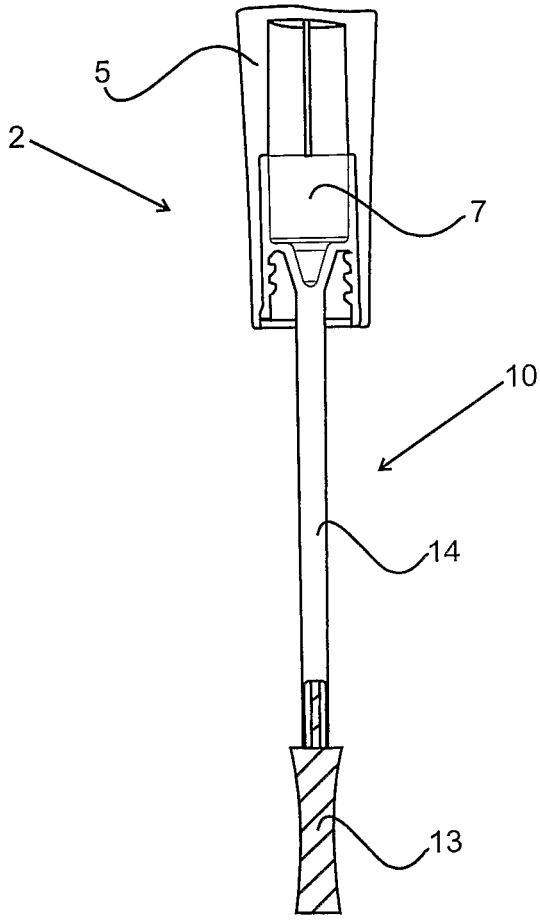
FIG. 3—refers to a side cut of the cap, the cap refill, the applicator, a wand and brush object of the present invention.

The cap 2, as revealed in FIG. 3, comprises a cap refill 7 connectable to an outer cap container 5. An applicator 10, composed of a wand 14 and a brush 13, can be provided, according to a preferred embodiment of the invention.

Figure 6:
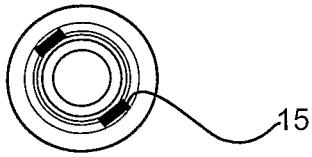
FIG. 6—refers to a side cut of the flask refill and the outer wall of the refill and inner wall of the refill that is the object of the present invention.

The flask 3 comprises a flask refill 8 connectable to an outer flask container 6 and to a base 9. Said flask refill 8 can be seen in FIGS. 4, 6 and 7. Said outer flask container 6 is constituted of materials present in the state of the art.

In terms of packaging use according to the present invention, there are provided three different torsional moments, a first being to connect the flask 3 to the cap 2, the second torsional moment for detaching the flask refill 8, and the third torsional moment to detach the cap refill 7.

Figure 4:
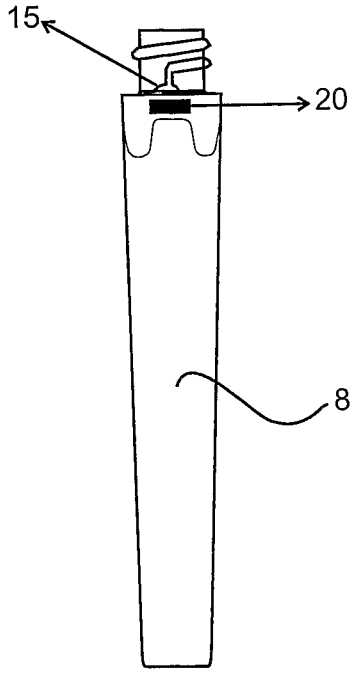
FIG. 4—refers to a side view of the flask refill, the accommodation ridge and lock.
Figure 5:
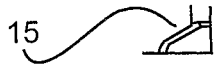
FIG. 5—refers to the extension of the lock illustrated in FIG. 4.

To ensure the feasibility of this use, the flask refill 8 presents in at least one of the ends at least a lock 15, as illustrated in FIGS. 4 and 5, on which force is applied to carry out the torsional moments. The lock 15 is triangular in shape and when the second torsional moment is applied, it allows the displacement of the flask refill, detaching the accommodation ridges 20 arranged radially to the axis of the flask refill 8. Preferably, the refill is connected through locks commonly used in the state of the art, for example, of the hook kind, in which case it is important to note whether the connection should be less accentuated, so that the combination can be subsequently disassembled by the user.

Besides at least one lock 15, there is at least one anti-rotation device on the refill mounting of the flask 8 and refill of the cap 7 (not illustrated) and also on the combination of the base 9 and outer flask container 6 of the refill 4. This allows opening without any false turns of any of the parts.

Figure 7:
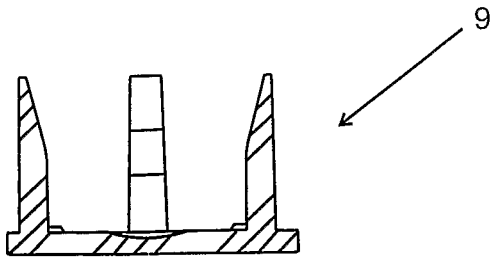
FIG. 7—refers to an overhead view of the flask refill and the locks that are the object of the present invention.
Figure 8:
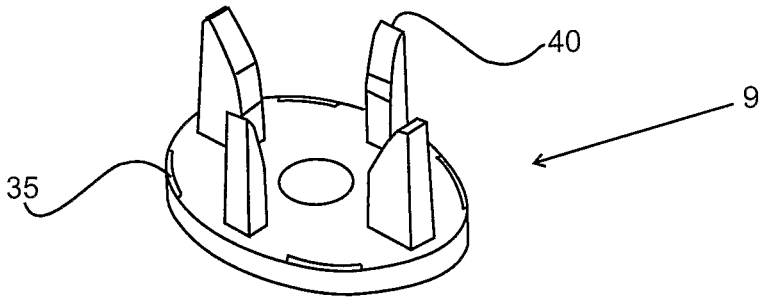
FIG. 8—refers to a side view of the base of the flask that is the object of the present invention.
Figure 9:
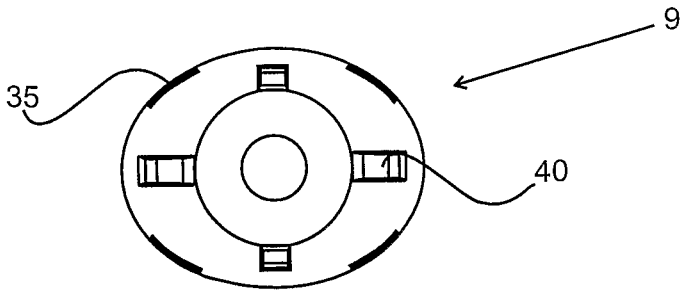
FIG. 9—refers to perspective view of the base of the flask with the axial projections and radial ridges.

The base 9, illustrated in FIGS. 7, 8 and 9, presents axial projections 40 to accommodate the flask refill 8. The base 9 also presents radial ridges 35 that assist the connection of the base to the outer flask container 6.

In a preferred embodiment of the invention, when transmitting the first torsional moment, the cap 2 is connected to the flask 3 avoiding spillage of the content of the packaging 1.

When transmitting the second torsional moment, substantially greater than the first torsional moment, the outer flask container 6 becomes released from the flask refill 8 and stays connected to the rest of the packaging 1. When transmitting the third torsional moment, which requires more strength, or a greater torsional moment than the second torsional moment, the cap refill 7 is detached from the outer cap container 5 and thus is detached from the cap 2, thus allowing the withdrawal of the cap refill 7.

In the teachings of the present invention, the sequence of operations should be thus so that the user has greater contact area to apply the second force to the combination because if the outer cap container 5 is released first, it would be harder to withdraw the remainder of the refill 4, because the contact area would be smaller.

In the preferred embodiment of the invention, to ensure the feasibility of this concept of the invention, the locks 15 and the accommodation ridges 20 should be designed such that the second torsional moment is at least 2.5 to 10 times greater than the first torsional moment, the third torsional moment is about 5 to 25 times greater than the first torsional moment. Further, according to this preferred embodiment, the third moment should be about 2 to 2.5 times greater than the second torsional moment. The connection of the parts with each other occurs within the same range of values.

Exemplifying this preferred embodiment, the first torsional moment falls within the range of about 0.1 to 1.0 kgf, or 0,980665 N to 9,80665 N, the second torsional moment in the range of 1.0 to 2.5 kgf, or 9,80665N to 24,516625 N, and the third torsional moment in the range of 2.5 to 5.0 kgf, 24,516625 N to 49,03325N.

As can be seen in the example of the embodiment above, the graduation of strengths of the torsional moments is defined without intervals between the ranges, that is, the withdrawal range of a part starts at exactly the same value as the following range begins, forming an uninterrupted sequence of ranges of torsional moments.

It is important to point out that substituting the cap refill 7 is applicable preferably in mascaras, however the cap refill 7 can be used for other purposes comprising or not an applicator 10.

The procedure of mounting a new flask refill 8 is carried out by inserting a new refill 4 in the outer cap container 5, forming the combination of the outer cap container 5 and refill 4; next, the combination of the outer flask container 6 and base 9 should be inserted into the outer cap container 5 and refill 4 combination, and transmit the first torsional moment, the connection of the new refill 4 occurs by the same first torsional moment in which the flask refill 8 is encased when the accommodation ridges 20 arranged radially to the axis of the flask refill 8 connect to the outer flask container 6. The process of connecting the cap refill 7 is similar to the process of connecting the flask refill 8, by torsional moment.

It is important to note that the present invention provides an advantage over the solutions of the state of the art whereby it permits the exchange of the refill from the make up packaging, without compromising the aesthetics of the product and its functional characteristics.

Moreover, the make up packaging now described will not be discarded with said refill is changed, thus avoiding wastage of non-biodegradable material.

It is worthy of note that the structure of the make up packaging and refill, as revealed in the present invention, has a simplified configuration compared to prior arts.

Said configuration also provides a reduction in manufacturing costs, which can be passed on to the end consumer.

Additionally, the process of substituting the refill 4, in accordance with the teachings of the present invention, requires no additional procedures besides the torsional moment similar to the opening and closing process of the proposed packaging.

Lastly, the present make up packaging is applicable preferably in mascaras, however said packaging can be used for other purposes.

Having described examples of preferred embodiments, it must be understood that the scope of the present invention encompasses other potential variations, and is only limited by the content of the claims appended hereto, including possible equivalents therein.

The invention claimed is:

1. Make up packaging comprising:

a cap comprising a cap refill connectable to an outer container of the cap, the cap refill being positioned inside the outer container of the cap; and a flask comprising a flask refill connectable to an outer container of the flask, the flask refill being positioned inside the outer container of the flask;

wherein:

the cap is connectable to and detachable from the flask via a first torsional moment;

the flask refill is connectable to and detachable from the outer container via a second torsional moment, the second torsional moment being greater than the first torsional moment; and the cap refill is connectable to and detachable from the cap via a third torsional moment, the third torsional moment being greater than the second torsional moment.

2. Make up packaging according to claim 1, wherein the second torsional moment is from about 2.5 to about 10 times greater than the first torsional moment.

3. Make up packaging according to claim 1, wherein the torsional moments comprise strength ranges.

4. Make up packaging according to claim 3, wherein the strength ranges of the torsional moments are uninterrupted.

5. Make up packaging according to claim 1, wherein the third torsional moment is from about 5 to about 25 times greater than the first torsional moment.

6. Make up packaging according to claim 1, wherein the third moment is from about 2 to about 2.5 times greater than the second torsional moment.

7. Make up packaging according to claim 1, wherein a range of the first torsional moment is from about 0.980665 N to about 9.80665 N, a range of the second torsional moment is from about 9.80665N to about 24.516625 N, and a range of the third torsional moment is from about 24.516625 N to about 49.03325N.

8. Make up packaging according to claim 1, wherein the flask refill is interlocked with the outer flask container and with the outer container of the cap refill.

9. Make up packaging according to claim 8, wherein the flask comprises an accommodation base with at least an axial projection to accommodate the flask refill.

10. Make up packaging according to claim 9, wherein the flask refill is connectable to the accommodation base.

11. Make up packaging according to claim 8, wherein the flask refill comprises an applicator composed of a wand and a brush.

12. Make up packaging according to claim 9, wherein the second torsional moment detaches the flask refill from the accommodation base.

13. Refill comprising:

a cap refill of a cap; and a flask refill of a flask, wherein the flask refill is connected to an outer flask container, and the flask is configured to be connected to a cap via a first torsional moment, wherein the flask refill is configured to be detachable from the outer flask container via a second torsional moment greater than the first moment; and wherein the cap refill is configured to be detachable from the cap via a third torsional moment greater than the prior moments.

14. Method of substituting refill of a make up packaging, a make up packaging comprising a cap and a flask, the cap comprising a cap refill connectable to an outer container of the cap and being positioned inside the outer container of the cap, the flask comprising a flask refill connectable to an outer container of the flask, the flask refill being positioned inside the outer container of the flask, the method being characterized by comprising the steps of:

(a) transmitting a first torsional moment to connect the cap to the flask;

(b) transmitting a second torsional moment, greater than the first moment to detach the flask refill from the outer flask container; and (c) transmitting a third torsional moment, greater than the prior moments to detach the cap refill from the cap.

15. Method according to claim 14, wherein the second torsional moment is from about 2.5 to about 10 times greater than the first torsional moment.

16. Method according to claim 14, wherein the third torsional moment is from about 10 to about 25 times greater than the first torsional moment.

17. Method, according to claim 14, wherein the third torsional moment is from about 2 to about 2.5 times greater than the second torsional moment.

18. Method of substituting a refill of make up packaging, according to claim 14, wherein a range of the first torsional moment is from about 0.980665 N to about 9.80665 N, a range of the second torsional moment is from about 9.80665N to about 24.516625 N, and a range of the third torsional moment is from about 24.516625 N to about 49.03325N.

* * * * *